US005480167A

United States Patent [19]

Johnson

[11] Patent Number: 5,480,167

[45] Date of Patent: Jan. 2, 1996

[54] TABLE-TOP MINIATURE GOLF GAME

[76] Inventor: Tony I. Johnson, Rte. 4 Box 310-J, Rocky Mount, N.C. 27801

[21] Appl. No.: 369,107

[22] Filed: Jan. 5, 1995

[51] Int. Cl.[6] ..... A63B 67/02

[52] U.S. Cl. ..... 273/176 R; 273/87 R

[58] Field of Search ..... 273/176 R, 176 E, 273/176 F, 87 R, 87 C, 87 D, 87 B, 87.2

[56] References Cited

U.S. PATENT DOCUMENTS

| | | | |
|---|---|---|---|
| D. 82,533 | 11/1930 | Harris | 273/87 D X |
| D. 83,110 | 1/1931 | Kimmins | 273/87 D X |
| D. 84,068 | 5/1931 | Andrus | 273/87 D X |
| D. 157,950 | 4/1950 | Goldstein | 273/87 D X |
| D. 263,725 | 4/1982 | Booth | D21/1 |
| 1,732,574 | 10/1929 | Brown et al. | 273/87.2 |
| 1,864,500 | 6/1932 | Livingston et al. | 273/87.2 |
| 2,470,302 | 5/1949 | Green | 273/87.2 |
| 2,750,192 | 6/1956 | Haslett | 273/87.2 |
| 3,084,941 | 4/1963 | Anthony | 273/176 E |
| 3,534,961 | 10/1970 | Tiley | 273/87 C |
| 3,868,111 | 2/1975 | Schuelke | 273/87 C |
| 3,884,469 | 5/1975 | Morton | 273/87.2 |
| 4,114,876 | 9/1978 | Maruszak | 273/87 B |
| 4,239,217 | 12/1980 | Thieme et al. | 273/87.4 |
| 4,790,534 | 12/1988 | Jamison | 273/87.2 |

*Primary Examiner*—William H. Grieb

[57] ABSTRACT

A table-top miniature golf game comprising a plurality of spheres and with each sphere constituting a golf ball; a plurality of golf clubs with each club having a toe at one end for striking a golf ball and a handle at the other end for allowing a user a firm grip; and at least one transportable playing surface constituting a golf course positionable upon a table top for use, the golf course having a plurality of holes formed thereon, each hole further having a generally elongated shape with a starting end constituting a tee, a concluding end constituting a green, and a lane therebetween constituting a fairway, each green of each hole including a cup and with the cup sized for receiving a golf ball therein.

13 Claims, 6 Drawing Sheets

TABLE-TOP MINIATURE GOLF GAME

BACKGROUND OF THE INVENTION

1. Field of the Invention

The present invention relates to a table-top miniature golf game and more particularly pertains to allowing users to play a round of golf with a table-top miniature golf game.

2. Description of the Prior Art

The use of miniature golf games is known in the prior art. More specifically, miniature golf games heretofore devised and utilized for the purpose of allowing a user or group of users to play a round of golf are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 263,725 to Booth discloses a table-top golf game board. U.S. Pat. No. 3,884,469 to Morton discloses a portable table-top miniature golf game provided with rearrangeable hole modules and separate green putting board. U.S. Pat. No. 4,114,876 to Maruszak discloses a pool table golf game. U.S. Pat. No. 4,239,217 to Thieme et al. discloses a table-top golf game apparatus. U.S. Pat. No. 4,790,534 to Jamison discloses a table-top golf game.

While these devices fulfill their respective, particular objective and requirements, the aforementioned patents do not describe a table-top miniature golf game that allows a group a users to play a game of golf upon an elevated transportable playing surface that has borders which surround each hole to ensure golf balls are contained within an area of interest.

In this respect, the table-top miniature golf game according to the present invention substantially departs from the conventional concepts and designs of the prior art, and in doing so provides an apparatus primarily developed for the purpose of allowing users to play a round of golf.

Therefore, it can be appreciated that there exists a continuing need for new and improved table-top miniature golf game which can be used for allowing users to play a round of golf. In this regard, the present invention substantially fulfills this need.

Summary of the Invention

In the view of the foregoing disadvantages inherent in the known types of miniature golf games now present in the prior art, the present invention provides an improved table-top miniature golf game. As such, the general purpose of the present invention, which will be described subsequently in greater detail, is to provide a new and improved table-top miniature golf game and method which has all the advantages of the prior art and none of the disadvantages.

To attain this, the present invention essentially comprises, in combination, a plurality of rigid magnetically attractive metal spheres with each sphere constituting a golf ball and with each golf ball having a diameter of about ¼ inch. A plurality of golf clubs are provided with each club having a rigid elongated shaft with an upper end and a lower end, a toe having a curved neck portion integral with the lower end of the shaft and a face portion extended angularly outwards from the neck portion for striking a golf ball, a handle coupled around the upper end of the shaft for allowing a user a firm grip, and a magnet coupled to and extended axially outwards from the upper end of the shaft for retrieving one of the golf balls during play. Each club further has a length of about 3⅛ inches.

Two similarly shaped transportable playing surfaces are provided with the surfaces constituting a golf course positionable upon a table top for use. Each playing surface has a rectangular plate with a upper surface and a lower surface and a periphery interconnecting the surfaces formed of a front edge, a rear edge, and a pair of opposed side edges. Each plate further has a width of about 11⅔ inches and a length of about 25⅓ inches. Each plate additionally has a layer of felt fabric coupled to the upper surface thereof. Each playing surface further has a peripheral elevated boundary formed thereon at a location adjacent to the rear edge and side edges thereof and with each boundary formed of a plurality of dowels positioned in an end-to-end configuration and with each dowel having a diameter of about ¼ inch.

The golf course has eighteen holes. Nine holes are formed on one playing surface constituting a front nine. The holes of the front nine are numbered "1" through "9", respectively. Another nine holes are formed on the other playing surface constituting a back nine. The holes of the back nine are numbered "10" through "18", respectively. Each hole further has a generally elongated shape with a starting end constituting a tee, a concluding end constituting a green, and a lane therebetween constituting a fairway. Each hole additionally has its fairway and green demarcated by a plurality of dowels positioned in an end-to-end configuration to thereby create an elevated border constituting a rough and with each dowel having a diameter of about ¼ inch. Each green of each hole includes a bore disposed thereon constituting a cup and with the cup sized for receiving a golf ball therein. Each tee of each hole includes three spaced aligned concave indentations formed thereon and with each indentation used for removably holding one of the golf balls therein for striking with one of the clubs. At least one of the holes additionally has a hazard formed on its fairway and at least one of the holes additionally has an elevated area of play formed thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved table-top miniature golf game which has all the advantages of the prior art miniature golf games and none of the disadvantages.

It is another object of the present invention to provide a new and improved table-top miniature golf game which may be easily and efficiently manufactured and marketed.

It is a further object of the present invention to provide a new and improved table-top miniature golf game which is of durable and reliable construction.

An even further object of the present invention is to provide a new and improved table-top miniature golf game which is susceptible of a low cost of manufacture with regard to both materials and labor, and which accordingly is then susceptible of low prices of sale to the consuming public, thereby making such a table-top miniature golf game economically available to the buying public.

Still yet another object of the present invention is to provide a new and improved table-top miniature golf game which provides in the apparatuses and methods of the prior art some of the advantages thereof, while simultaneously overcoming some of the disadvantages normally associated therewith.

Even still another object of the present invention is to provide a new and improved table-top miniature golf game for allowing users to play a round of golf.

Lastly, it is an object of the present invention to provide a new and improved table-top miniature golf game comprising a plurality of spheres and with each sphere constituting a golf ball; a plurality of golf clubs with each club having a toe at one end for striking a golf ball and a handle at the other end for allowing a user a firm grip; and at least one transportable playing surface constituting a golf course positionable upon a table top for use, the golf course having a plurality of holes formed thereon, each hole further having a generally elongated shape with a starting end constituting a tee, a concluding end constituting a green, and a lane therebetween constituting a fairway, each green of each hole including a cup and with the cup sized for receiving a golf ball therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

With reference now to the drawings, the preferred embodiment of the new and improved table-top miniature golf game embodying the principles and concepts of the present invention will be described.

The present invention is comprised of a plurality of components. In their broadest context, such components include golf balls, golf clubs, and a golf course. Such components are individually configured and correlated with respect to each other to provide the intended function of allowing a group of users to play a game of golf on a table top.

Figure 8:
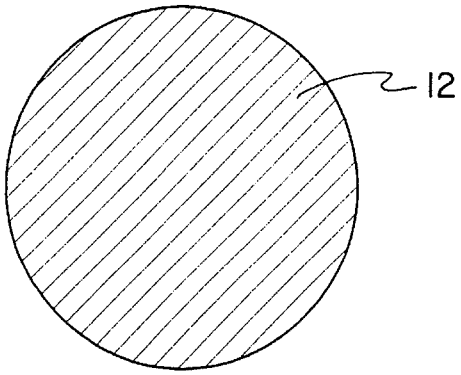
FIG. 8 is a cross-sectional view of a golf ball of the present invention.

Specifically, the present invention includes a plurality of rigid and magnetically attractive metal spheres as shown in FIG. 8. Each sphere constitutes a golf ball 12 for use. Each golf ball has a diameter of about ¼ inch. Preferably, the golf balls are formed of steel.

Figure 9:
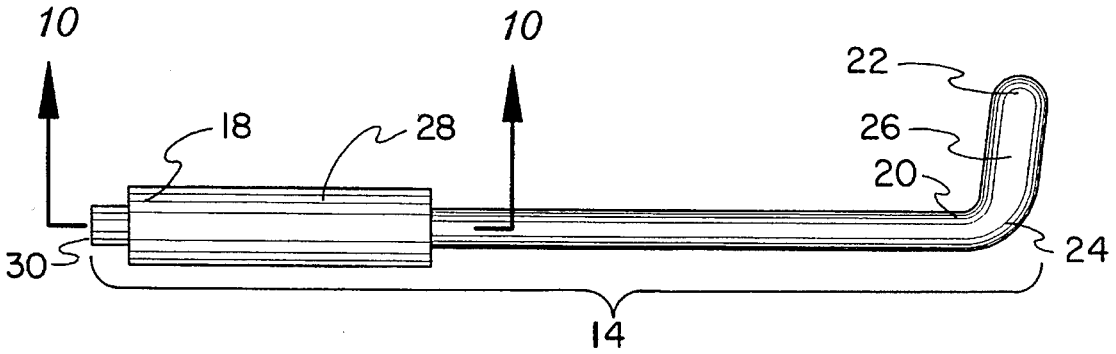
FIG. 9 is a view of one of the golf clubs of the present invention.
Figure 10:
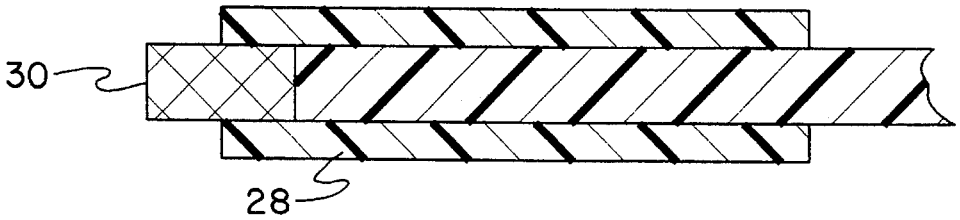
FIG. 10 is a cross-sectional view taken along the line 10—10 of FIG. 9.

Also provided is a plurality of golf clubs 14. As shown in FIG. 9, each club has a rigid elongated shaft 16 with an upper end 18 and a lower end 20. The shaft is formed of metal, plastic, or other such generally rigid material. Each club also includes an elongated rigid toe 22. The toe has a curved neck portion 24 integral with the lower end of the shaft and a face portion 26 extended angularly outwards from the neck portion. The face portion has a flat surface formed thereon that is used for striking a golf ball 12. Each golf club also includes a handle 28 coupled around the upper end of the shaft for allowing a user a firm grip during play. Additionally, each club includes a cylindrical magnet 30 coupled to and extended axially outwards from the upper end of the shaft. The magnet is used for retrieving one of the golf balls 12 during play. Preferably, each club has an axial length of about 3⅛ inch.

Figure 1:
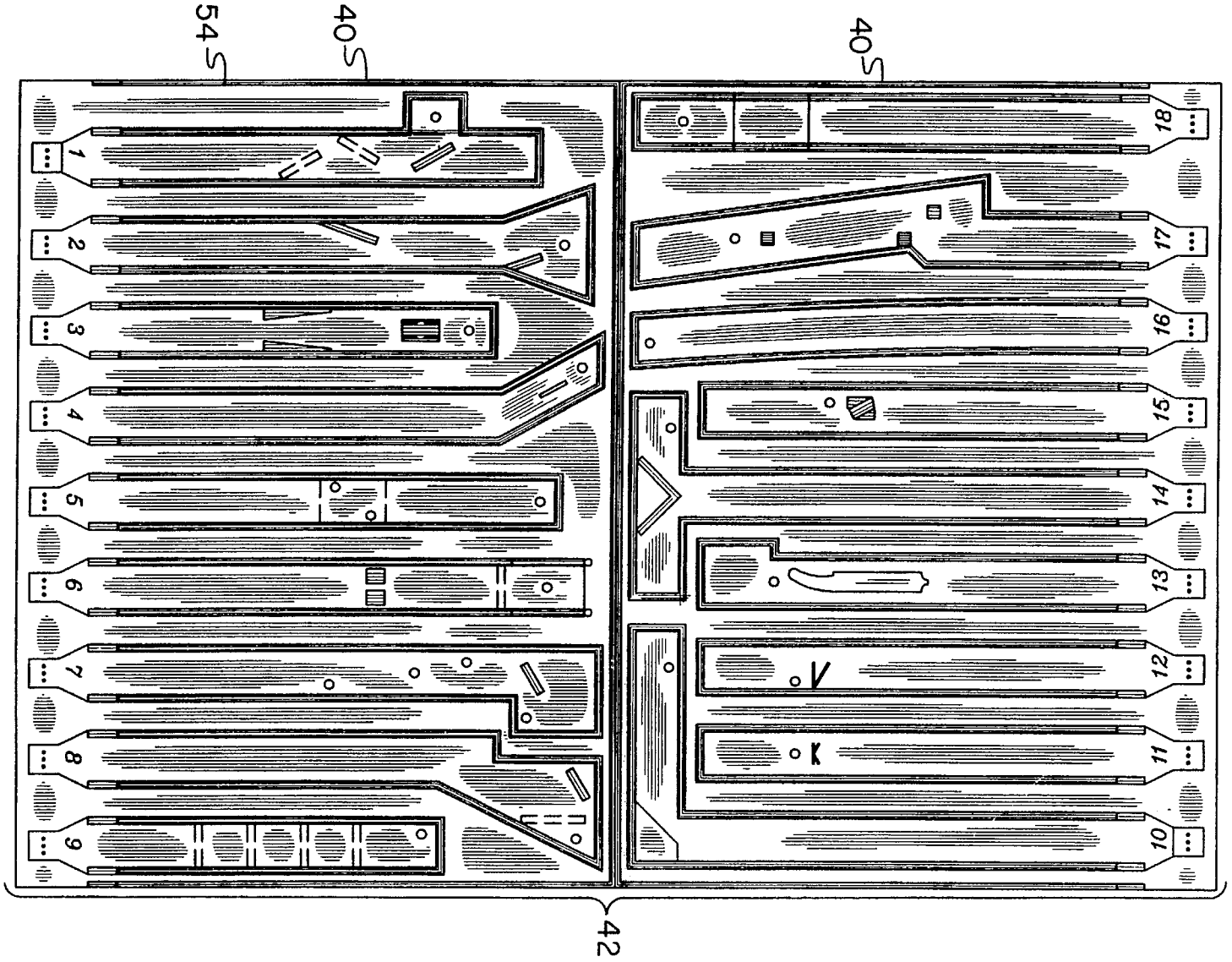
FIG. 1 is a plan view of the playing surfaces of the preferred embodiment of the present invention.
Figure 2:
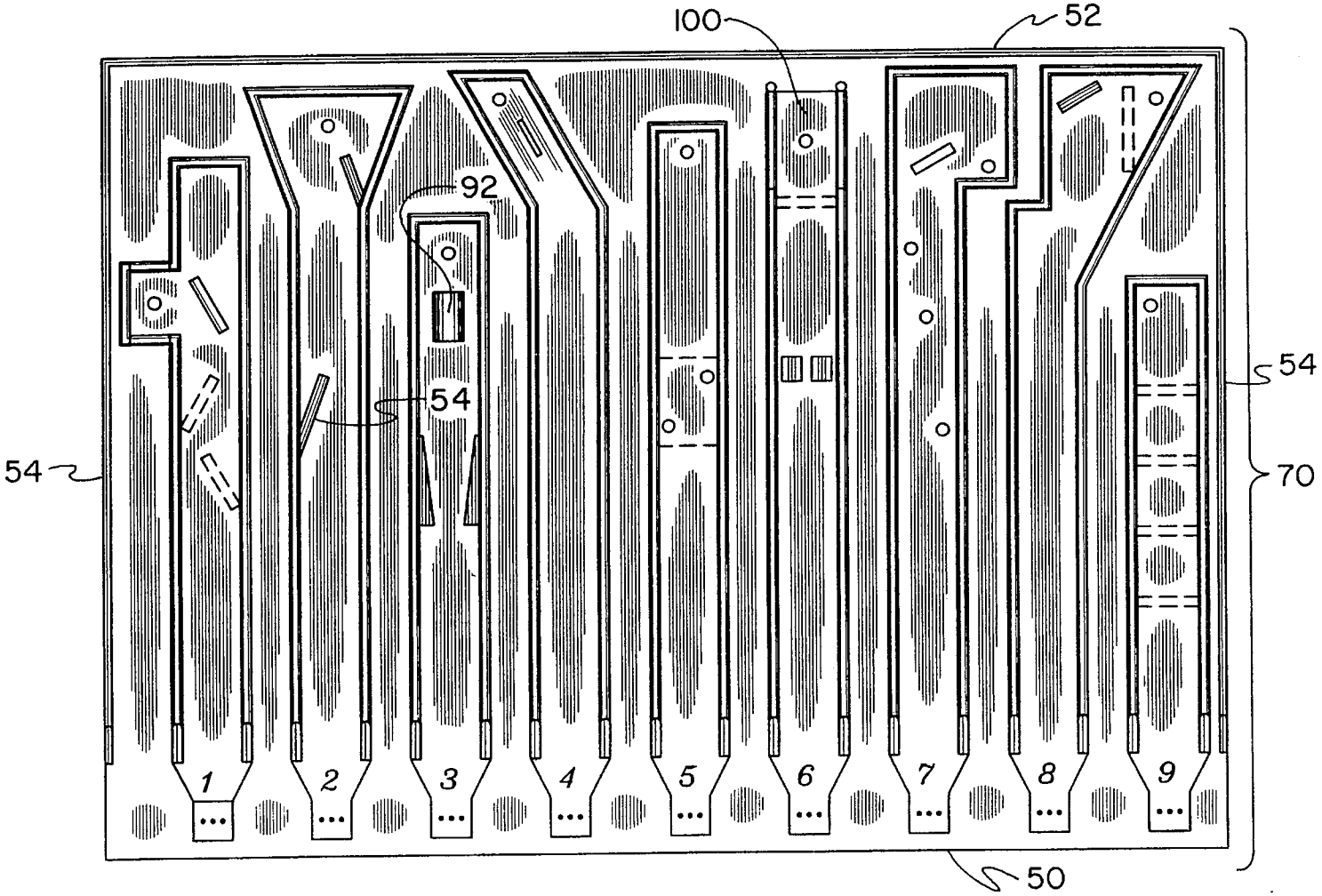
FIG. 2 is a plan view of a playing surface of the present invention with the front nine holes formed thereon.
Figure 3:
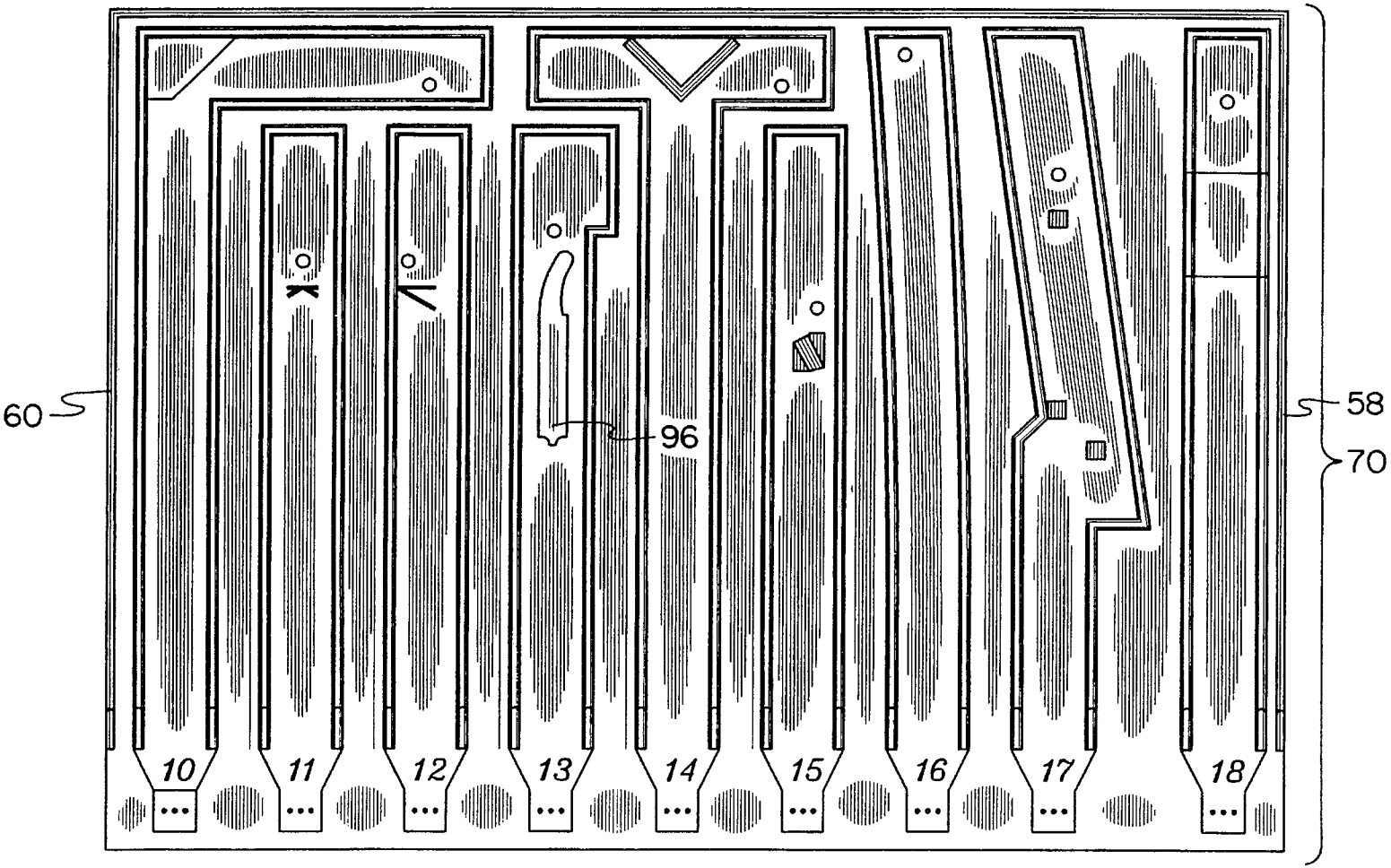
FIG. 3 is a plan view of a playing surface of the present invention with the back nine holes formed thereon.
Figure 5:
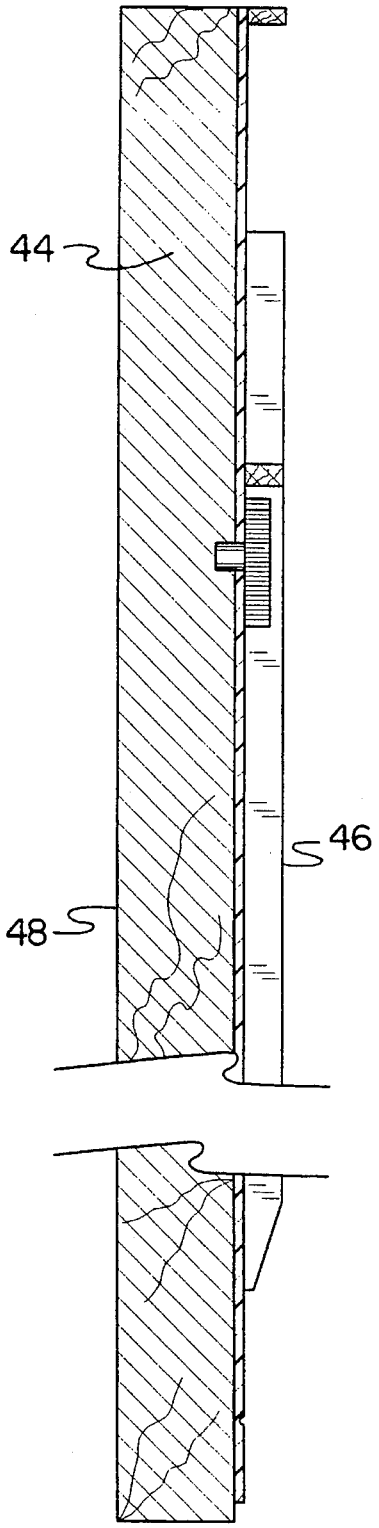
FIG. 5 is a cross-sectional view of the present invention taken along the line 5—5 of FIG. 4.
Figure 6:
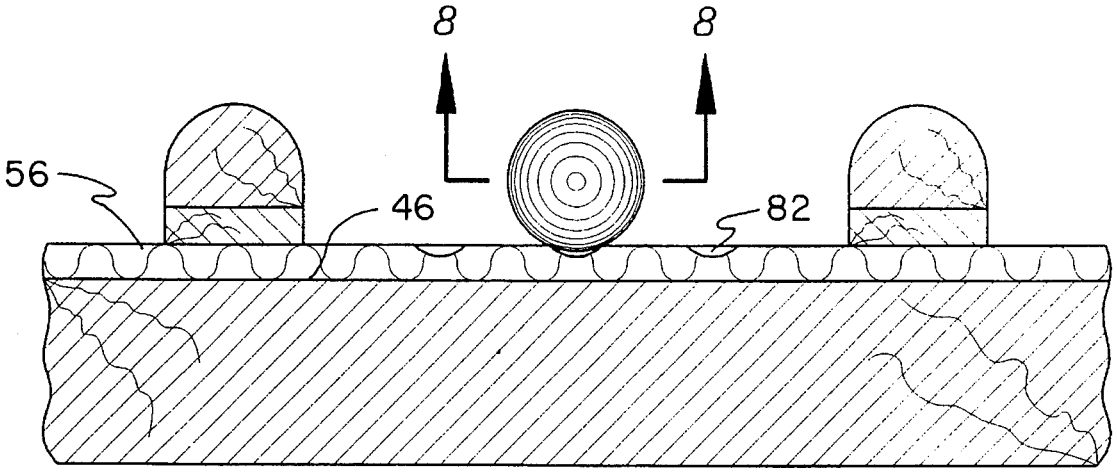
FIG. 6 is a cross-sectional view of the present invention taken along the line 6—6 of FIG. 4.
Figure 7:
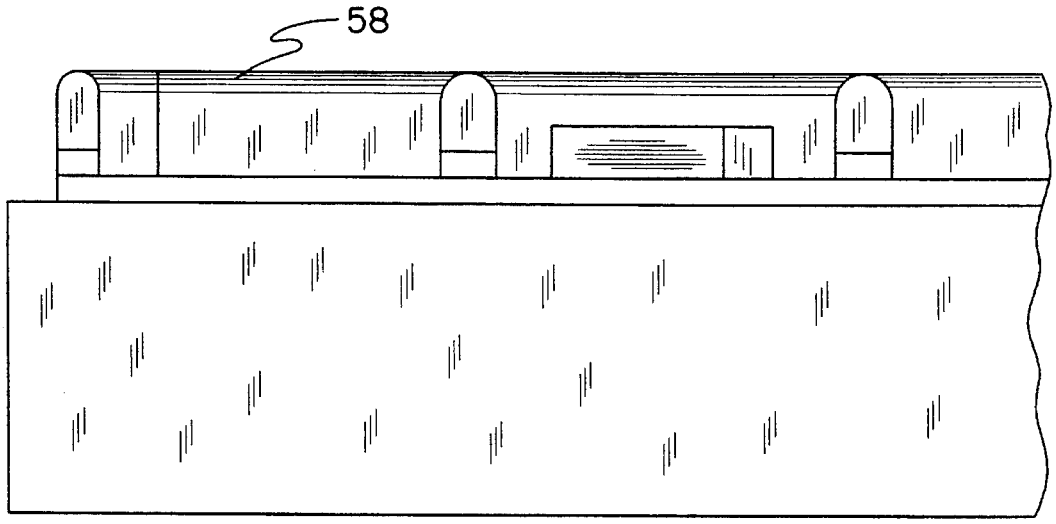
FIG. 7 is a side-elevational and fragmentary view of one of the playing surfaces of the present invention.

Also provided are two similarly shaped playing surfaces 40 as best illustrated in FIG. 1. The playing surfaces are readily transportable from one location to another and positionable in a juxtaposed level relation upon a table top for use. The playing surfaces in combination constitute a golf course 42. Referring to FIG. 5, each playing surface has a rectangular rigid wooden plate 44 with an upper surface 46 and a lower surface 48. A periphery interconnects the surfaces. The periphery is formed of a front edge 50, a rear edge 52, and a pair of opposed side edges 54 as illustrated in FIG. 2. Each wooden plate has a width of about 11⅔ inch and a length of about 25⅓ inch. Each plate additionally has a layer of green felt fabric 56 coupled to the upper surface 46 thereof. The green felt simulates grass found on conventional golf courses. Each playing surface 40 also has a peripheral elevated boundary 58 as shown in FIG. 3. The boundary is located adjacent to the rear edge and side edges of each playing surface. Each boundary is formed of a plurality of dowels 60 that are positioned in an end-to-end configuration. Each dowel of the boundary has a diameter of about ¼ inch. The boundary helps preclude golf from rolling off of the playing surface during use.

As shown in FIG. 1, the golf course has eighteen holes. Nine of the holes are formed on one playing surface and constitute a front nine 70 as shown in FIG. 2. The holes of the front nine are numbered "1" through "9", respectively. The other nine holes are formed on the other playing surface and constitute a back nine 72 as shown in FIG. 3. The holes of the back nine are numbered "10" through "18", respectively.

Figure 4:
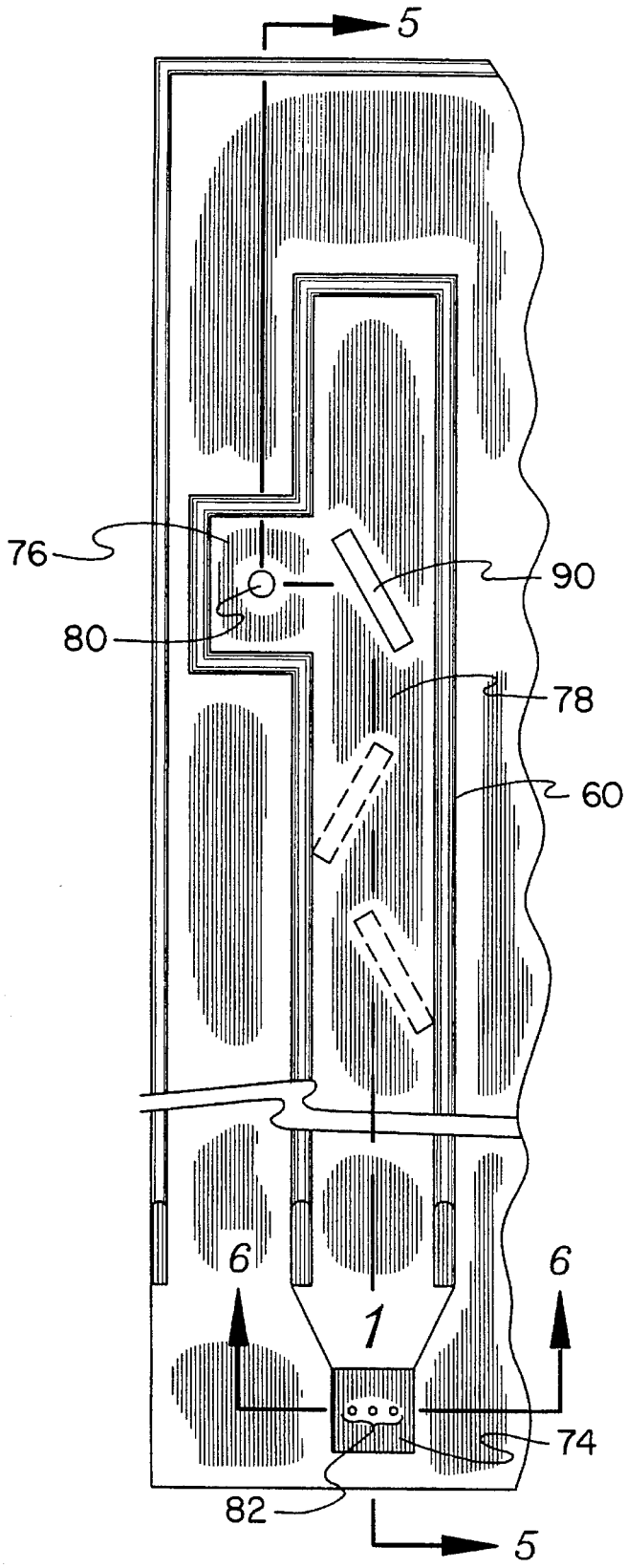
FIG. 4 is a view of one of the holes of the present invention.

As best illustrated in FIG. 4, each hole has a generally elongated shape with a starting end constituting a tee 74, a concluding end constituting a green 76, and a lane therebetween constituting a fairway 78. As shown in FIG. 1, all of the holes begin near the front edge of the playing surface and end near the rear edge of the playing surface. The holes are positioned in a generally aligned and sequential relation. Some of the holes are generally straight such as hole "11" and hole "18", while others dogleg to the left such as hole "4" and hole "17", while still others dogleg to the right such as hole "8" and hole "10". Each hole additionally has its fairway and green demarcated by a plurality of dowels 60 positioned in an end-to-end configuration to thereby create an elevated border as shown in FIG. 4. This border constitutes a rough and functionally prevents one of the golf balls in play from traveling onto an adjacent hole. Each dowel of the border has a diameter of about ¼ inch. Each green of each hole includes a bore disposed thereon constituting a cup 80 as shown in FIG. 4. The cup is sized for receiving a golf ball therein. Furthermore, as shown in FIG. 4, each tee 74 of each hole includes three spaced and aligned concave indentations 82 formed thereon. Each indentation is used for removably holding one of the golf balls 12 therein for striking with one of the clubs during play.

Furthermore, at least one of the holes additionally has a hazard 90 formed on its fairway as illustrated in FIG. 4. Such hazards such as a tube 92 on hole "3", a block 94 on hole "15", or a depression 96 on hole "13" are used to increase the difficulty of play. The hazards essentially simulate trees, water, or sand traps conventional found on actual golf courses. Additionally, at least one of the holes has an elevated area of play 100 formed thereon as illustrated in FIG. 2. For example, hole "6" has its green elevated. Elevated portions can also be included on fairways to increase the difficulty of play.

The present invention is a miniature golf game that relies on conventional rules of golf for exciting game play, but which is small enough to be played on a table-top. The present invention is played through a series of holes that are essentially lanes with borders. A steel ball and a reduced scale golf club are also provided. The base of each lane is made from ¼ inch thick wood that is covered with 1/16 inch thick green felt lining. The borders are fabricated from ¼ inch diameter dowels that are cut and installed to create the borders for the fairways of the individual holes. Each tee area has three recessed dimples or indentations that are used to tee-up a small steel golf ball. The miniature golf club can be used for putting as well as for driving. It has a small club face and a magnetic tip on the handle that can be used to quickly pick up a steel golf ball.

To play the game, the steel golf ball is positioned on the tee and hit using the club. The club can be twisted between the fingers for driving or gripped firmly for chipping and putting. Each hole is designed to be unique, with various hazards or obstacles to overcome to get the golf ball into the cup. To further make the game more challenging, some of the holes have elevated greens. Once the hole is reached and the ball is in the cup, the magnetic end of the club can is used to retrieve it.

Each cup of the present invention has a 5/16 inch diameter and a 3/16 inch depth. Each golf ball of the present invention has a ¼ inch diameter. The length of a golf club is approximately 3⅛ inch. The shaft of the golf club has a diameter of about ⅛ inch. The handle of the golf club is about 1⅛ inch in length. The thickness of the toe of the golf club of the invention is about 3/16 inch. The toe of the club is projected outwards from the central axis of the shaft at an angle of about 83 degrees. The width of a fairway adjacent to a tee is no greater than 2 inches. The width of a tee is about 1 inch.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A table-top miniature golf game for allowing users to play a round of golf comprising, in combination:

a plurality of rigid magnetically attractive metal spheres with each sphere constituting a golf ball and with each golf ball having a diameter of about ¼ inch;

a plurality of golf clubs, each club having a rigid elongated shaft with an upper end and a lower end, a toe having a curved neck portion integral with the lower end of the shaft and a face portion extended angularly outwards from the neck portion for striking a golf ball, a handle coupled around the upper end of the shaft for allowing a user a firm grip, and a magnet coupled to and extended axially outwards from the upper end of the shaft for retrieving one of the golf balls during play, each club further having a length of about 3⅛ inches; and two similarly shaped transportable playing surfaces constituting a golf course positionable upon a table top for use, each playing surface having a rectangular plate with a upper surface and a lower surface and a periphery interconnecting the surfaces formed of a front edge, a rear edge, and a pair of opposed side edges, each plate further having a width of about 11⅔ inches and a length of about 25⅓ inches, each plate additionally having a layer of felt fabric coupled to the upper surface thereof, each playing surface further having a peripheral elevated boundary formed thereon at a location adjacent to the rear edge and side edges thereof and with each boundary formed of a plurality of dowels positioned in an end-to-end configuration and with each dowel having a diameter of about ¼ inch, the golf course having eighteen holes with nine holes formed on one playing surface constituting a front nine and with the holes of the front nine numbered "1" through "9", respectively, and with another nine holes formed on the other playing surface constituting a back nine and with the holes of the back nine numbered "10" through "18", respectively, each hole further having a generally elongated shape with a starting end constituting a tee, a concluding end constituting a green, and a lane therebetween constituting a fairway, each hole additionally having its fairway and green demarcated by a plurality of dowels positioned in an end-to-end configuration to thereby create an elevated border constituting a rough and with each dowel having a diameter of about ¼ inch, each green of each hole including a bore disposed thereon constituting a cup and with the cup sized for receiving a golf ball therein, each tee of each hole including three spaced aligned concave indentations formed thereon and with each indentation used for removably holding one of the golf balls therein for striking with one of the clubs, and wherein at least one of the holes additionally has a hazard formed on its fairway and at least one of the holes additionally has an elevated area of play formed thereon.

2. A table-top miniature golf game comprising:

a plurality of spheres and with each sphere constituting a golf ball;

a plurality of golf clubs, each club having a toe at one end for striking a golf ball and a handle at the other end for allowing a user a firm grip; and at least one transportable playing surface constituting a golf course positionable upon a table for use, the golf course having opposed and parallel first and second longitudinal edges with a plurality of holes formed in the table and only extending from adjacent to the first longitudinal edge to adjacent to the second longitudinal edge thereof, each hole further having a generally elongated shape with a starting end constituting a tee positioned proximal to the first longitudinal edge of the golf course, a concluding end constituting a green positioned proximal to the second longitudinal edge of the golf course, and a lane extending substantially orthogonally relative to the first longitudinal edge between the tee and the green constituting a fairway, each green of each hole including a cup and with the cup sized for receiving a golf ball therein.

3. The table-top miniature golf game as set forth in claim 2 wherein each golf ball has a diameter of about ¼ inch.

4. The table-top miniature golf game as set forth in claim 2 wherein:

each golf ball is magnetically attractive; and each club includes a magnet coupled thereto for retrieving one of the golf balls.

5. The table-top miniature golf game as set forth in claim 2 wherein each club has a length of about 3⅛ inches.

6. The table-top miniature golf game as set forth in claim 2 wherein each playing surface is rectangular in shape and has a width of about 11⅔ inches and a length of about 25⅓ inches.

7. The table-top miniature golf game as set forth in claim 2 wherein each playing surface is formed of a rigid planar plate with a layer of felt fabric coupled thereupon.

8. The table-top miniature golf game as set forth in claim 2 wherein:

nine holes are formed on one playing surface constituting a front nine and with the holes of the front nine numbered "1" through "9" respectively, another nine holes are formed on the other playing surface constituting a back nine and with the holes of the back nine numbered "10" through "18" respectively.

9. The table-top miniature golf game as set forth in claim 2 wherein each hole additionally has its fairway and green demarcated by a border constituting a rough.

10. The table-top miniature golf game as set forth in claim 2 wherein each tee of each hole includes a plurality of indentations formed thereon and with each indentation used for removably holding one of the golf balls therein for striking with one of the clubs.

11. The table-top miniature golf game as set forth in claim 2 wherein at least one of the holes has a hazard formed on its fairway.

12. The table-top miniature golf game as set forth in claim 2 wherein at least one of the holes has an elevated area of play formed thereon.

13. The table-top miniature golf game as set forth in claim 2 wherein the playing surface includes a peripheral elevated boundary formed therearound.

* * * * *